US008436537B2

(12) United States Patent
Kim et al.

(10) Patent No.: US 8,436,537 B2
(45) Date of Patent: May 7, 2013

(54) SUBSTRATE STRUCTURE FOR PLASMA DISPLAY PANEL, METHOD OF MANUFACTURING THE SUBSTRATE STRUCTURE, AND PLASMA DISPLAY PANEL INCLUDING THE SUBSTRATE STRUCTURE

(75) Inventors: Chul-Hong Kim, Suwon-si (KR); Min-Jae Kim, Suwon-si (KR); So-Ra Chae, Suwon-si (KR); Eun-Gi Heo, Suwon-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 580 days.

(21) Appl. No.: 12/496,587

(22) Filed: Jul. 1, 2009

(65) Prior Publication Data

US 2010/0001641 A1 Jan. 7, 2010

Related U.S. Application Data

(60) Provisional application No. 61/078,730, filed on Jul. 7, 2008, provisional application No. 61/078,722, filed on Jul. 7, 2008.

(51) Int. Cl.
*H01J 17/49* (2006.01)

(52) U.S. Cl.
USPC ..... 313/587; 445/35

(58) Field of Classification Search ..... 313/311, 313/582–587; 445/35
See application file for complete search history.

(56) References Cited

U.S. PATENT DOCUMENTS 6,075,319 A * 6/2000 Kanda et al. ..... 313/584
6,355,586 B1 3/2002 Usui et al.
6,580,216 B1 6/2003 Lu et al.
7,582,404 B2 9/2009 Lee et al.
2002/0096666 A1 7/2002 Ichikawa et al.
2003/0090204 A1 * 5/2003 Joo et al. ..... 313/582
2004/0232840 A1 11/2004 Aoki et al.

(Continued)

FOREIGN PATENT DOCUMENTS

EP 1 780 747 A2 5/2007
EP 1 887 601 A1 2/2008

(Continued)

OTHER PUBLICATIONS

KIPO Office action dated Apr. 20, 2011, for corresponding Korean Patent application 10-2009-0061717.

(Continued)

*Primary Examiner* — Bumsuk Won
*Assistant Examiner* — Andrew Coughlin
(74) *Attorney, Agent, or Firm* — Christie, Parker & Hale, LLP

(57) ABSTRACT

A substrate structure for a plasma display panel (PDP), a method of manufacturing a PDP substrate structure of the PDP, and a PDP including the PDP substrate are provided. The PDP substrate structure includes a substrate, an electrode on the substrate and including a first layer and a second layer, the second layer including an aluminum (Al) material, the first layer being between the substrate and the second layer and including a conductive material, the first layer having lower specific resistance than that of the second layer; and a light absorbable layer on the substrate. The light absorbable layer is an oxidization product of the conductive material of the first layer.

23 Claims, 6 Drawing Sheets
(1 of 6 Drawing Sheet(s) Filed in Color)

U.S. PATENT DOCUMENTS

| | | | | |
|---|---|---|---|---|
| 2004/0251449 | A1 | 12/2004 | Yonezawa et al. | |
| 2006/0082308 | A1* | 4/2006 | Kawasaki | 313/583 |
| 2006/0164011 | A1 | 7/2006 | Lee et al. | |
| 2006/0166113 | A1 | 7/2006 | Lee et al. | |
| 2007/0079868 | A1 | 4/2007 | Rose et al. | |
| 2007/0092987 | A1 | 4/2007 | Kim | |
| 2008/0067938 | A1 | 3/2008 | Kim et al. | |
| 2008/0261077 | A1 | 10/2008 | Park et al. | |
| 2009/0295267 | A1 | 12/2009 | Park et al. | |
| 2010/0164357 | A1 | 7/2010 | Lee et al. | |

FOREIGN PATENT DOCUMENTS

| | | | |
|---|---|---|---|
| JP | 6-077004 | | 3/1994 |
| JP | 10-273341 | | 10/1998 |
| JP | 2000-072479 | | 3/2000 |
| JP | 2003-151450 | | 5/2003 |
| JP | 2003-187709 | | 7/2003 |
| JP | 2005-139407 | | 6/2005 |
| JP | 2005-203359 | | 7/2005 |
| JP | 2006-011449 | | 1/2006 |
| JP | 2006-139989 | | 6/2006 |
| JP | 2007-100214 | | 4/2007 |
| JP | 2008-108719 | | 5/2008 |
| KR | 2000-0027527 | | 5/2000 |
| KR | 2000-0056857 | | 9/2000 |
| KR | 10-2007-0052170 | | 5/2007 |
| KR | 10-2007-0095497 | | 10/2007 |
| KR | 10-2007-0111195 | | 11/2007 |
| KR | 10-0781326 | B1 | 11/2007 |
| WO | WO 2006/129929 | A2 | 12/2006 |
| WO | WO 2008/010623 | A1 | 1/2008 |

OTHER PUBLICATIONS

Japanese Office action dated Oct. 4, 2011, for corresponding Japanese Patent application 2009-161119, 2 pages.
Patent Abstracts of Japan, and English machine translation of Japanese Publication 2000-072479, 35 pages.
European Search Report dated Aug. 2, 2010, for corresponding European Patent application 09251751.5.
European Search Report dated Aug. 3, 2010, for European Patent application 09251753.1.
KIPO Notice of Allowance for corresponding Korean patent application No. 10-2009-0061716, dated Aug. 4, 2011, 5 pages.
USPTO Office action for related U.S. Appl. No. 12/464,804, dated Aug. 31, 2011, 23 pages.
Japanese Japanese Office action dated Dec. 20, 2011, for corresponding Japanese Patent application 2009-161120, 2 pages.
Patent Abstracts of Japan, and English machine translation of Japanese Publication 2005-139407, listed above, 38 pages.
U.S. Office action dated Dec. 15, 2011, for cross-reference U.S. Appl. No. 12/464,804, 20 pages.
Japanese Office action dated Jul. 31, 2012, for Japanese Patent application 2009-161119, (2 pages).
U.S. Office action dated Mar. 15, 2012, for cross reference U.S. Appl. No. 12/464,804, (18 pages).
U.S. Notice of Allowance dated Aug. 14, 2012, for cross reference U.S. Appl. No. 12/464,804, (8 pages).
Patent Abstracts of Japan, and English machine translation of Japanese Publication 2006-139989 listed above (41 pages).
Patent Abstracts of Japan, and English machine translation of Japanese Publication 2008-108719 listed above (19 pages).

* cited by examiner

SUBSTRATE STRUCTURE FOR PLASMA DISPLAY PANEL, METHOD OF MANUFACTURING THE SUBSTRATE STRUCTURE, AND PLASMA DISPLAY PANEL INCLUDING THE SUBSTRATE STRUCTURE

CROSS-REFERENCE TO RELATED APPLICATIONS

This application claims priority to and the benefit of U.S. Provisional Patent Application Nos. 61/078,730 and 61/078,722, both filed on Jul. 7, 2008, in the United States Patent and Trademark Office, the entire contents of which are incorporated herein by reference.

BACKGROUND

1. Field of the Invention

The present invention relates to a plasma display (PDP) and, more particularly, to a PDP substrate structure of the PDP and its manufacturing method.

2. Description of the Related Art

A plasma display panel (PDP) is a display device for realizing an image by gas discharge. That is, the gas discharge generates plasma, the plasma radiates vacuum ultraviolet (VUV) rays, the VUV rays excite phosphors, and the excited phosphors are stabilized to generate red (R), green (G), and blue (B) visible light.

For example, in one type of PDP, address electrodes are formed on a first (or rear) substrate, and a dielectric layer is formed on the first substrate to cover the address electrodes. Barrier ribs are formed in a stripe pattern on the dielectric layer between the respective address electrodes. Red (R), green (G), and blue (B) phosphor layers are formed on inner surfaces of the barrier ribs and on a surface of the dielectric layer.

Display electrodes (e.g., a sustain electrode and a scan electrode formed in pairs) are formed on a second (or front) substrate extending in a direction crossing the address electrodes.

Discharge cells are partitioned by the barrier ribs, and are formed at crossing regions of the address electrodes and the display electrodes. Accordingly, millions (or more) of the discharge cells can be arranged in a matrix format in the PDP.

In one embodiment, the second (or front) substrate is formed on a light transparent material, such as glass, and the display electrodes are made of a transparent conductive material so that they do not interfere with the light reaching the second substrate.

Most transparent conductive materials utilized in the formation of the display (or transparent) electrodes have high electrical resistance as compared to opaque metallic materials. The high resistant electrodes may cause the PDP to run at a slower rate, with higher voltage drop and/or with more power consumption. One approach for enhancing the conductivity of transparent electrodes is to use bus (or metal conductive) electrodes, which are placed in contact with the transparent electrodes. Accordingly, there is a continued need to improve the conductivity of the metal conductive electrodes, (e.g. lower the resistance, particularly, specific resistance of a PDP electrode after sintering) and the overall conductivity of the electrodes.

SUMMARY OF THE INVENTION

In the context of embodiments of the present invention, a specific resistance refers to a product of a resistance per a unit area and the unit volume for an electrode formed utilizing a sintering process.

In general, the lower the specific resistance of an electrode (e.g., a bus electrode for a plasma display panel (PDP)), the higher the conductivity of the electrode. As an example, aluminum (Al), which is a relatively inexpensive electrode material, typically has a relatively high specific resistance of about 100 μΩ·cm or more. As such, a conventional Al electrode has a relatively low conductivity.

According to an embodiment of the present invention, an electrode (e.g., a bus electrode for a PDP) includes a first layer and a second layer. The second layer is formed on a substrate and includes an aluminum (Al) material. The first layer is formed between the substrate and the second layer and includes a conductive material having lower specific resistance than that of Al. A light absorbable layer is formed on the substrate and adjacent to the electrode, the light absorbable layer being an oxidization product of the conductive material of the first layer. As such, the electrode includes Al that is relatively inexpensive, not a noble metal, and can be formed using a photolithographic method that does not require an expensive apparatus; and, at the same time, the electrode can have a relatively low specific resistance (e.g., about 20 μΩ·cm or less).

Also, in one embodiment, the second layer further includes a surface treatment agent that protects the Al material from oxidation. Furthermore, in one embodiment, the first layer formed into the electrode also has a portion extending out from the electrode that is oxidized to form the light absorbable layer, thereby simplifying the manufacturing process.

Another embodiment of the present invention is directed toward a PDP substrate structure including a substrate, an electrode on the substrate, and a light absorbable layer on the substrate. In one embodiment, the light absorbable layer is an oxidization product of the conductive material of the first layer. The electrode includes a first layer having a conductive material that has a lower specific resistance than that of the second layer and a second layer comprising an aluminum (Al) material. The first layer is between the substrate and the second layer.

In one embodiment, the second layer further includes a surface treatment agent that protects the Al material from oxidation, specifically the Al material is covered with the surface treatment agent. In one embodiment, the surface treatment agent includes cellulose ether and the Al material includes sintered Al particles.

The conductive material of the first layer may include copper (Cu) or nickel (Ni). In one embodiment, the light absorbable layer is substantially black in color and acts as an insulator for protecting the electrode from an electrical short circuit. The electrode may have a specific resistance of about 20 μΩ·cm or less.

According to one embodiment of the present invention, there is provided a PDP that includes a first substrate, a second substrate facing the first substrate, a first electrode on the first substrate, extending along a first direction, and including a first layer and a second layer, the second layer having an aluminum (Al) material, the first layer being between the first substrate and the second layer and including a conductive material having lower specific resistance than that of Al, a light absorbable layer on the first substrate and adjacent to the first electrode, the light absorbable layer being an oxidization product of the conductive material of the first layer, a dielectric layer on the first substrate to cover the first electrode and the light absorbable layer, and a second electrode spaced apart from the first electrode and on the second substrate, and extending along a second direction crossing the first direction.

In one embodiment, the PDP further includes a third electrode between the first substrate and the first electrode and extending in the first direction. The third electrode may be a transparent electrode. The first electrode may be a bus electrode on the transparent electrode, and the second electrode may be an address electrode.

In another embodiment, the PDP further includes a barrier rib between the first electrode and the second electrode, where the light absorbable layer corresponds in position to a portion of the barrier rib extending in the first direction to overlap with the portion of the barrier rib extending in the first direction. The second layer may further include a surface treatment agent for protecting the Al material from oxidation, where the Al material includes sintered Al particles.

According to another embodiment of the present invention, there is provided a method of manufacturing a PDP substrate structure. The method includes forming a first conductive layer on a substrate having a conductive material having lower specific resistance than that of aluminum (Al), forming a second conductive layer on the first conductive layer having an Al material, forming a second conductive layer pattern by patterning the second conductive layer to expose a first portion of the first conductive layer, forming an electrode by sintering a second portion of the first conductive layer covered by the second conductive layer pattern to combine the second portion of the first conductive layer with the second conductive layer pattern, and forming a light absorbable layer by oxidizing the first portion of the first conductive layer exposed by the second conductive layer pattern.

In one embodiment, the forming of the second conductive layer includes forming an Al liquid composition that includes Al particles and a surface treatment agent for protecting the Al particles from oxidation. The amount of the Al particles may range from about 18 to about 40.8 (or from 18 to 40.8) parts by weight in the second conductive layer. The amount of the surface treatment agent may range from about 3 to about 34 (or from 3 to 34) parts by weight in the second conductive layer. The amount of the Al particles may range from about 30 to about 60 (or from 30 to 60) parts by weight based on 100 parts by weight of the Al liquid composition. The amount of the surface treatment agent may range from about 5 to about 50 (or from 5 to 50) parts by weight based on 100 parts by weight of the Al liquid composition.

In another embodiment, the second conductive layer is formed from an Al liquid composition that includes a mixture of Al particles and a surface treatment agent at an amount ranging from about 60 to about 68 (or from 60 to 68) parts by weight, glass frits at an amount ranging from about 2.5 to about 5.5 (or from 2.5 to 5.5) parts by weigh, and a vehicle at an amount ranging from about 15.5 to about 37.5 (or from 15.5 to 37.5) parts by weight.

According to yet another embodiment of the present invention, the method of manufacturing a PDP substrate structure includes forming a first conductive layer on a substrate that includes a conductive material, forming a second conductive layer on the first conductive layer that includes an Al material, forming a second conductive layer pattern by patterning the second conductive layer to expose a first portion of the first conductive layer forming an electrode by sintering a second portion of the first conductive layer covered by the second conductive layer pattern to combine the second portion of the first conductive layer with the second conductive layer pattern, the electrode having specific resistance lower than 20 $\mu\Omega\cdot$cm, and forming a light absorbable layer by oxidizing the first portion of the first conductive layer exposed by the second conductive layer pattern.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The accompanying drawings, together with the specification, illustrate exemplary embodiments of the present invention, and, together with the description, serve to explain the principles of the present invention.

DETAILED DESCRIPTION

Figure 1:
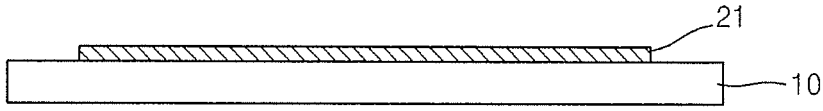
FIGS. 1-5 are sectional schematic views illustrating a method of manufacturing a PDP substrate structure for a plasma display panel (PDP), according to an embodiment of the present invention.

In the following detailed description, only certain exemplary embodiments of the present invention are shown and described, by way of illustration. As those skilled in the art would recognize, the invention may be embodied in many different forms and should not be construed as being limited to the embodiments set forth herein. Also, in the context of the present application, when an element is referred to as being "on" another element, it can be directly on another element or be indirectly on another element with one or more intervening elements interposed therebetween. Like reference numerals designate like elements throughout the specification.

Hereinafter, a substrate structure for a plasma display panel (PDP), a method of manufacturing a PDP substrate structure of the PDP, and a PDP including the PDP substrate structure will be described in more detail with reference to the accompanying drawings, in which exemplary embodiments of the invention are shown.

A method of manufacturing a PDP substrate structure, according to an embodiment of the present invention, and a PDP substrate structure manufactured using the method will now be described in more detail with reference to FIGS. 1-5. FIGS. 1-5 are sectional schematic views illustrating a method of manufacturing a PDP substrate structure for a plasma display panel (PDP), according to an embodiment of the present invention.

Referring to FIG. 1, a glass substrate 10 is provided and a first conductive layer 21 is formed on the glass substrate 10. The first conductive layer 21 includes a conductive material that has lower specific resistance than that of aluminum (Al). A second conductive layer 25 (FIG. 2), which is to be formed later on the first conductive layer 51 includes Al. Accordingly, the specific resistance of Al included in the second conductive layer 25 can be compensated by the conductive material included in the first conductive layer 21. The conductive material may be a black conductive material, such as copper (Cu). The conductive material may also be nickel (Ni), which has a higher specific resistance than Al.

In one embodiment of the present invention, specific techniques and additives are used to reduce the specific resistance of a PDP electrode after sintering. Here, in the context of the present embodiment, the specific resistance is referred to as a measurement of resistance per unit area and per unit volume of an electrode.

The first conductive layer 21 can be formed utilizing various suitable methods. For example, a first paste including the conductive material may be printed on the glass substrate 10 followed by exposure and development processes to form a desirable pattern. Other examples of applying the first paste onto the glass substrate include, but are not limited to, screen printing, off-set printing, and/or ink-jet printing. The first paste may include conductive material powders, glass frits, and/or a vehicle (or vehicles) utilized for exposure and development processes. The vehicle may include a photo initiator, a crosslinking agent, and a binder.

As such, the first conductive layer 21 having a desirable pattern can be formed by suitable printing, exposing and/or developing processes. After the first conductive layer 21 is formed (or coated), the second conductive layer 25 can be coated thereon and exposed. The exposed first conductive layer 21 and the exposed second conductive layer 25 can be developed at the same time (or substantially the same time). The exposure and development processes will be described in more detail later.

In one embodiment, the first conductive layer 21 on the glass substrate 10 is formed utilizing pellets including the conductive material. In another embodiment, the pellets further include glass frits. The pellets may be deposited on the substrate by various deposition methods such as sputtering or an electron-beam evaporation method.

In one embodiment of the present invention, the first conductive layer 21 includes any suitable conductive material having a specific resistance lower than that of Al. Therefore, materials for forming the first conductive layer 21 and methods of forming the first conductive layer 21 are not limited to those described above but rather can be any suitable method and material in any suitable amount that is suitable for forming the first conductive layer 21. For example, the method of forming the first conductive layer 21 with the conductive material having the suitable composition ratio can be any suitable known method or a method that can be derived from the known method.

Figure 5:
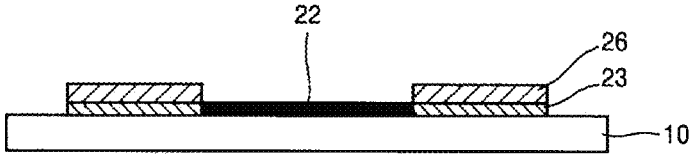

In one embodiment, the first electrode layer 21 has a region that is formed into an electrode 20 and a region that is formed into a light absorbable layer 22 (FIG. 5).

Figure 2:
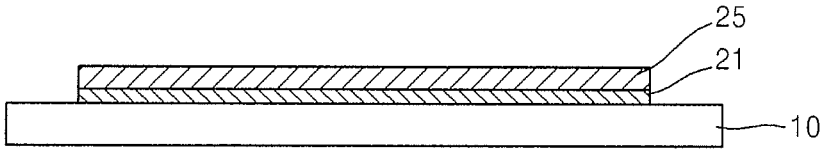

Referring to FIG. 2, a second conductive layer 25 is formed with a second paste on the first conductive layer 21. The second paste may contain 60 to 68 parts by weight of an Al liquid composition, which includes Al and a surface treatment agent that is not combustible at 550° C. or higher, 2.5 to 5.5 parts by weight of glass frit, and 15.5 to 37.5 parts by weight of a vehicle.

Specifically, the second paste is applied to the first conductive layer 21 and then dried to form the second conductive layer 25.

As described above, the Al liquid composition includes Al and a surface treatment agent that is not combustible at 550° or higher.

Generally, as the particle radius of Al particles increases, the specific resistance of Al reduces. Therefore, in terms of specific resistance, utilizing large particle sizes of Al particles (or large Al particles) would appear to be useful. However, large Al particles tend to create a PDP electrode with a porous surface and, as a result, discharge gas may flow through. This is referred to as a leak phenomenon. Due to these reasons, in certain embodiments of the present invention, an average particle radius of Al particles included in the Al liquid composition is in a range of 5 μm or less.

That is, in one embodiment of the present invention, most Al particles included in the Al liquid composition have a radius of 5 μm or less. Specifically, as long as the leak phenomenon does not occur, most of the Al particles included in the Al liquid composition may have a radius of 5 μm or less. Herein, in one embodiment, the phrase "an average particle radius of Al included in the Al liquid composition may be in a range of 5 μm or less" should not be construed as that all the particles Al particles have a radius of 5 μm or less, or that the average radius of all Al particles is 5 μm or less. That is, the Al liquid composition can include Al particles having a radius greater than 5 μm in a small or trace amount so long as the leak phenomenon does not occur.

In another embodiment, all the particles Al particles have a radius of 5 μm or less. In yet another embodiment, the average radius of all Al particles is 5 μm or less.

The amount of Al may be in a range of about 18 to about 40.8 (or from 18 to 40.8) parts by weight in the second paste. In one embodiment, if the amount of Al is less than 18 parts by weight, it is difficult to prepare the second paste as the viscosity and solid-content density of the paste decrease, thereby forming voids on the second conductive layer 25 (FIG. 2). In another embodiment, if the amount of Al is greater than 40.8 parts by weight, hydrogen gas and/or explosion may occur due to inter-reactions of the Al particles that may occur during the second paste preparation process. Moreover, too much Al can reduce light rays from passing through the second conductive layer 25, and thus resulting in insufficient crosslinking and an undesirable pattern formation.

The surface treatment agent is not combustible at a sintering temperature or higher and remains in its original state when a PDP electrode is manufactured by photolithography. Since the second paste is sintered at 550° C. or higher, the surface treatment agent is preferably not combustible at 550° C. or higher and remains in its original state. In some embodiments, the surface treatment agent itself can remain on the surface of Al particles without evaporation in the sintering process. In some cases, however, decomposition products of the surface treatment agent can remain on the surface of Al particles.

The surface treatment agent may be cellulose ether prepared by etherifying a hydroxyl group of cellulose. Not limiting examples of suitable cellulose ethers include methylcellulose, ethylcellulose, hydroxyethylcellulose, benzylcellulose, tritylcellulose, cyanoethylcellulose, carboxymethylcellulose, carboxyethylcellulose, aminoethylcellulose, a derivative thereof that is not combustible at 550° C. or higher and so forth. Specifically, the surface treatment agent may be any suitable ethylcellulose having high heat stability characteristics or derivatives thereof.

The amount of the surface treatment agent may be in a range of about 3 to about 34 (or 3 to 34) parts by weight in the second paste. In one embodiment, if the amount of the surface treatment agent is less than 3 parts by weight, it is difficult to prepare the second paste. In another embodiment, if the amount of the surface treatment agent is greater than 34 parts by weight, Al may be oxidized when the sintering process is performed to form a PDP electrode.

The Al liquid composition may further include a dispersant and a solvent. The dispersant facilitates stable dispersion of Al particles, and hinders agglomeration or precipitation of Al particles. The dispersant may include a compound that has a functional group having a polarity and affinity for other suitable polar surfaces, and/or a polymer compound, but is not limited thereto. The functional group may be a carboxylic group, a hydroxyl group, and/or an acid ester group. The solvent is used to prepare the Al liquid composition, and can be any suitable organic or inorganic solvent. Non-limiting examples of suitable solvents include ketones, alcohols, ether-based alcohols, saturated aliphatic monocarboxylic acid alkyl esters, lactic acid esters, ether-based esters, combinations thereof, etc.

In addition, the Al liquid composition may further include an additive, such as antioxidants, optical stabilizers, ultraviolet (UV) absorbers, lubricants, pigments, or flame retardants. Any suitable amount of the additive may be used so long as it does not interfere with the sintering process. That is, in one embodiment, the additive will not have any adverse impact on the surface treatment agent such that the agent and/or its decomposition products can remain on the surface of Al particles, specifically on the surface of Al particles that form a surface of the PDP electrode after being exposed to the sintering process. In one embodiment, the amount of the additive is about 5 parts by weight or less.

The amount of the Al liquid composition may be in a range of 60 to 68 parts by weight. In one embodiment, if the amount of the Al liquid composition is less than 60 parts by weight, voids can form on the PDP electrode forming from the second paste. In another embodiment, if the amount of the Al liquid composition is greater than 68 parts by weight, hydrogen gas and/or explosions may occur due to inter-reactions of the Al particles.

The glass frit helps with Al particles necking. Nonlimiting examples of suitable glass frits include Pb, B, Si, Bi, P, Li, Zn, Ba, and Sn. Specifically, the glass frit may be a mixture of oxides of the metals described above, such as $Bi_2O_3$—$B_2O_3$-based oxides, $Bi_2O_3$—$B_2O_3$—ZnO-based oxides, $P_2O_5$—SnO—ZnO-based oxides, or $B_2O_3$—SnO—BaO-based oxides. The glass frit usually exists in powder form.

The amount of the glass frit may be in a range of 2.5 to 5.5 parts by weight. In one embodiment, if the amount of the glass frit is less than 2.5 parts by weight, resistance of the PDP electrode may increase and the adhesive force of the PDP electrode may reduce, due to insufficient liquid material for particles necking. In another embodiment, if the amount of the glass frit is greater than 5.5 parts by weight, the Al particles may conglomerate or form an island, resulting in a second conductive layer with a high resistance.

The vehicle, which is used in the photolithography process, may include a photo initiator, a crosslinking agent, and a binder.

The photo initiator can be any suitable compound that generates radicals in the photolithography process and initiates crosslinking reactions of the crosslinking agent. Nonlimiting examples of suitable photo initiators include benzophenone, 4,4-bis(dimethylamino)benzophenone, 4,4-bis (diethylamino) benzophenone, 2,2-diethoxyacetophenone, 2,2-dimetoxy-2-phenyl-2-phenylacetophenone, 2-methyl-[4-methylthio phenyl]-2-morpolynopropane-1-on, 2-benzyl-2-dimethylamino-1-4-morpolynophenyl-1-butanone, bis 2,6-dimethoxybenzoyl-2,4,4-trimethylpentylphosphineoxide, bis 2,4,6-trimethylbenzoyl phenylphosphineoxide, and combinations thereof.

The amount of the photo initiator may be in a range of about 0.01 to about 4.5 (or from 0.01 to 4.5) parts by weight based on 100 parts by weight of the vehicle. In one embodiment, if the amount of the photo initiator is less than 0.01 parts by weight based on 100 parts by weight of the vehicle, exposure sensitivity of the second paste may degrade. In another embodiment, if the amount of the photo initiator is greater than 4.5 parts by weight based on 100 parts by weight of the vehicle, the line width of an exposed portion may be small or an unexposed portion may not develop, and thus accurate electrode patterns may not be obtained.

The crosslinking agent may be any suitable compound that can participate in a radical polymerization reaction initiated by the photo initiator. The crosslinking agent may be, for example, a single-functional or multi-functional monomer. Specifically, the use of the multi-functional monomers is desirable to improve the exposure sensitivity of the second paste. Nonlimiting examples of suitable multi-functional monomers include diacrylates, such as ethyleneglycoldiacrylate (EGDA); triacrylates, such as trimethylolpropantriacrylate (TMPTA), trimethylolpropanethoxyratetriacrylate (TMPEOTA), or pentaerisritoltriacrylate; tetraacrylates, such as tetramethylolpropantetraacrylate or pentaerisritoltetraacrylate; hexaacrylates such as dipentaerisritolhexaacrylate (DPHA); and combinations thereof.

The amount of the crosslinking agent may be in a range of 0.01 to 2.0 parts by weight based on 100 parts by weight of the vehicle. In one embodiment, if the amount of the crosslinking agent is less than 0.01 parts by weight based on 100 parts by weight of the vehicle, in an exposure process, the exposure sensitivity of the second paste may degrade. As a result, in the development process, the electrode pattern may have defects. In another embodiment, if the amount of the crosslinking agent is greater than 2.0 parts by weight based on 100 parts by weight of the vehicle, the line width of an exposed portion after the development process may increase and accurate electrode patterns cannot be obtained. Moreover, after the sintering process, residue may form in the vicinity of the electrode.

The binder enables the second paste to have an appropriate viscosity when the second paste is coated on the first conductive layer 21. Therefore, printing characteristics of the second paste and necking characteristics of the Al particles can be improved. Further, the binder helps the Al particles to be better attached to the first conductive layer 21 or the glass substrate 10. The binder may be a polymer that can be crosslinked by the photo initiator and can be easily removed in the development process. Nonlimiting examples of suitable binders include monomers containing a carboxyl group, monomers containing a hydroxyl group, and polymerizable monomers. Nonlimiting examples of suitable monomers containing a carboxyl group include acetate, metacetate, fumaric acid, crotonic acid, itaconic acid, cytraconic acid, mesaconic acid, cinnamic acid, succinic acid mono(2-(meth)acryloyloxyethyl), w-carboxy-polycaprolactonemono(meth)acrylate, and so forth. Nonlimiting examples of suitable monomers containing a hydroxyl group include a hydroxyl group-containing monomers, such as (meth)acetate 2-hydroxyethyl, (met)acetate2-hydroxypropyl, or (met)acetate3-hydroxypropyl; and a phenolic hydroxyl group-containing monomers such as o-hydroxystyrene, m-hydroxystyrene, or p-hydroxystyrene. Nonlimiting examples of suitable initial polymerizable monomers include (met)acetate esters, such as (met) acetatemethyl, (met)acetateethyl, (met)acetate n-butyl, (met) acetate n-lauryl, (met)acetate benzyl, glycidyl(met)acrylate, dicycloropentanyl(met)acrylate, etc.; aromatic vinyl monomers such as styrene, α-methyl styrene, etc.; conjugated dienes such as butadiene, isoprene, etc.; and macromonomers having (met)acryloyl group, which is a polymerization unsaturated group at an end of a polymerization chain, such as polystyrene, poly(met)acetatemethyl, poly(met)acetateethyl, poly(met)acetate benzyl, etc.

The amount of the binder may be in a range of 0.05 to 5.0 parts by weight based on 100 parts by weight of the vehicle. In one embodiment, if the amount of the binder is less than 0.05 parts by weight based on 100 parts by weight of the vehicle, the second paste may be easily separated from the PDP substrate or the PDP electrode during the exposure and development processes. In another embodiment, if the amount of the binder is greater than 5.0 parts by weight based on 100 parts by weight of the vehicle, the development process may be inefficiently performed.

The vehicle may further include a solvent, and an additive according to the purpose of use. The solvent may be an organic or inorganic solvent that is commonly used in the art. Nonlimiting examples of suitable solvents include ketones, alcohols, ether-based alcohols, alkyl esters of saturated aliphatic monocarboxylic acid, lactic acid esters, ether-based esters, and combinations thereof. The additive may be a dispersant that disperses Al particles, a sensitizer that improves sensitivity, a polymerization inhibitor and an antioxidant that improve stability of the electrode forming composition, a UV absorber that improves resolution, an anti-foaming agent that reduces formation of bubbles in a paste, a leveling agent that improves planarization properties of a printed film, or a plasticizer that imposes thixotropic properties. The additive does not have to be used in all cases. However, it can be used when necessary, and when it is used, the amounts of the additive may be appropriately determined based on the amounts that are generally known in the art.

The amount of the vehicle may be in a range of 15.5 to 37.5 parts by weight in the second paste. In one embodiment, if the amount of the vehicle is less than 15.5 parts by weight, the vehicle may affect the viscosity of the second paste, therefore good printing characteristics cannot be obtained and exposure sensitivity of the second paste may be degraded. In another embodiment, if the amount of the vehicle is greater than 37.5 parts by weight, the amount of Al particles is accordingly reduced. In such cases, the conductive layer may shrink too much during the sintering process, resulting in void formations on the PDP electrode forming from the second paste.

Figure 3:
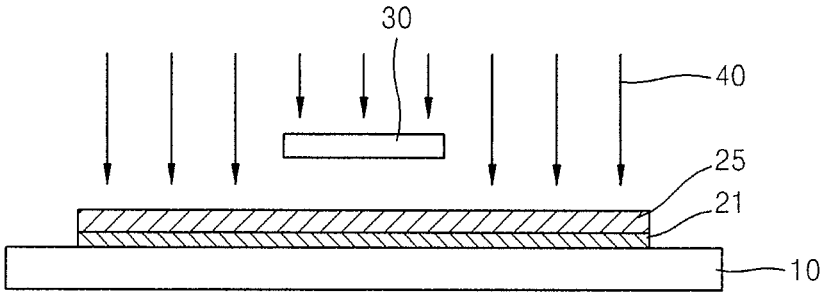

Referring to FIG. 3, there is shown an exposure mask 30 disposing above and spacing apart from the second conductive layer 25. The whole assembly is subjected to an exposure process. The exposure mask 30 is used to form electrodes. The mask has a pattern that selectively exposes the second conductive layer 25, specifically, a pattern that exposes portions of the second conductive layer 25, which are formed into electrodes later on. When radioactive rays 40 that are not selectively blocked by the exposure mask 30, the rays irradiated through and reached the binder and the second conductive layer 25 crosslinking agent. As a result, the second conductive layer 25 is hardened by the photo initiators. The exposure process can be performed with any suitable exposure device that emits radioactive rays, such as visible rays, UV rays, far infrared rays, electronic rays, or X rays.

Figure 4:
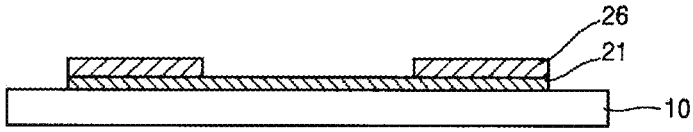

The exposed second conductive layer 25 is developed such that exposed portions of the second conductive layer 25 remain and any unexposed portion of the second conductive layer 25 is removed, thereby forming a second conductive layer pattern 26, as illustrated in FIG. 4. In the development process, a developing solution is used, which can be an alkaline solution including a base. Nonlimiting examples of suitable base include inorganic alkaline compounds such as lithium hydroxide, sodium hydroxide, potassium hydroxide, sodium hydrogen phosphate, diammonium hydrogen phosphate, dipotassium hydrogen phosphate, disodium hydrogen phosphate, ammonium dihydrogen phosphate, potassium dihydrogen phosphate, sodium dihydrogen phosphate, lithium silicate, sodium silicate, potassium silicate, lithium carbonate, sodium carbonate, potassium carbonate, lithium borate, sodium borate, potassium borate, and ammonia; and an organic alkaline compound, such as tetramethylammoniumhydroxide, trimethylhydroxyethylammoniumhydroxide, monomethylamine, dimethylamine, trimethylamine, monoethylamine, diethylamine, triethylamine, monoisopropylamine, diisopropylamine, or ethanolamine. The developing solutions described above are just examples of various suitable developing solutions that can be used according to the present invention and are not limited to the compounds described above.

The development process may be performed in conditions that are known in the art. Specifically, the types or concentrations of the developing solution, the development time periods, temperatures, methods, and devices used may be the same (or substantially the same) as those used and generally known in the art. The development method may be performed by dipping, shaking, showering, spraying, and/or paddling. In general, a washing process is performed after a development process is completed. In an embodiment of the present invention, after the development process is completed, a washing process may be performed to remove undesirable residue that may be present on a side of the second conductive layer pattern 26, on an exposed portion of the first conductive layer 21, and/or on an exposed portion of the glass substrate 10.

The second conductive layer pattern 26 exposes a portion of the first conductive layer 21.

The exposure process that is used in the embodiment of the present invention as shown is a positive exposure process. However, the present invention is not limited to the positive exposure process. For example, a negative exposure process can also be used based on the type of photo initiator, binder and crosslinking agent.

In one embodiment, the sintering process is performed at a temperature of 550° C. to 650° C. for about 10 minutes to about 3 hours in a reducing or oxidizing atmosphere.

Referring to FIGS. 4 and 5, in the sintering process, portions of the first conductive layer 21 that are covered by the second conductive layer pattern 26 are combined with the second conductive layer pattern 26 to form an electrode 20, and the portion of the first conductive layer 21 that is exposed by the second conductive layer pattern 26 is oxidized to form a light absorbable layer 22.

In one embodiment, the electrode 20 includes a composite including the conductive material, Al and glass frit. In another embodiment, the electrode 20 further includes a surface treatment agent that is not combusted in the sintering process and remains on Al particles. Due to presence of the surface treatment agent on Al particles, oxidation of Al particles can be reduced or prevented in the sintering process. When the sintering process is completed, Al has a specific resistance of about 20 μΩ·cm or less. Generally, the lower the specific resistance of an electrode forming material, the higher its conductivity will be. In one embodiment, the Al has a specific resistance of about 20 μΩ·cm or less, which is less than conventional Al, which has a specific resistance of about 100 μΩ·cm or more.

The light absorbable layer 22 is formed by oxidizing the portion of the first conductive layer 21 that is exposed by the second conductive layer pattern 26. The light absorbable layer 22 includes an oxidization product of the conductive material. The oxidization product is a high insulating material and prevents (or protects from) shorts of the electrode 20. The conductive material may be a black conductive material, specifically, a black metal. When the conductive material is black, the oxidation product of the conductive material is also black and thus, the light absorbable layer 22 can absorb external light. In the context of the present embodiment, the light absorbable layer 22 is also referred to as a black matrix.

According to an embodiment of the present invention, the electrode 20 includes Al that is relatively inexpensive and is not a noble metal, and is formed utilizing a photolithographic method that does not require an expensive apparatus. In addition, specific resistance of the Al can-be compensated by further forming a black conductive layer. Furthermore, the black conductive layer is formed into the electrode 20 and, at the same time (or substantially the same time), oxidized to form the light absorbable layer 22, thereby simplifying the manufacturing process. Therefore, by using such an inexpensive material, an inexpensive apparatus, and a simple manufacturing process, the yield can be increased.

Hereinafter, an experimental example in which a first conductive layer and a second conductive layer are formed and sintered to form a PDP electrode and a light absorbable layer will be described.

Preparation of First Paste 62.0 g of copper powder, 4.0 g of glass frit, 2.0 ml of a photo initiator, 5.0 ml of a crosslinking agent, 2.0 ml of a binder, and 5 ml of a dispersant were added to 200 ml of ethanol and the mixture was stirred.

The obtained mixture was further mixed and dispersed with a stirrer, and the resultant mixture was filtered and degassed to form a first paste.

The glass frit was a mixture of $SiO_2$, PbO, $Bi_2O_3$, ZnO and BaO, the photo initiator was 2,2-dimethoxy-2-phenyl-2-phenylacetophenone, and the crosslinking agent was tetramethylolpropane tetraacrylate. The binder was a mixture of a methylmethacrylate/methacrylic acid (MMA/MAA) copolymer, hyd roxypropyl cellulose (HPC), ethylcellulose (EC), and poly isobutyl methacrylate (PIBMA).

Preparation of Second Paste 1000 g of an Al liquid composition was prepared using 600 g of aluminum powder, 50 g of ethylcellulose (EC) and 350 g of ethyl alcohol. The aluminum powder contained aluminum particles having an average particle size of 5 μm. The ethanol contained 0.4 μl of dispersant Disperbyk-190 (from BYK).

Then, 1000 g of the Al liquid composition, 50 g of glass frit, 3.5 g of a photoinitiator, 3.5 g of a cross-linking agent, and 16.5 g of a binder were added to 326.5 ml of ethyl alcohol and agitated. A mixture of $SiO_2$, PbO, $Bi_2O_3$, ZnO, and BaO was used as the glass frit. 2,2-dimethoxy-2-phenyl-2-phenyl acetophenone was used as the photoinitiator. Tetramethylolpropane tetraacrylate was used as the cross-linking agent. Also, a mixture of methyl methacrylate/methacrylate (MMA/MAA) copolymer, hydroxypropyl cellulose (HPC), ethylcellulose (EC), and poly(isobutyl methacrylate) (PIBMA) was used as the binder.

Then, agitation and dispersion were further performed in an agitator, and then filtering and degassing processes were performed to manufacture a second paste.

Preparation of Electrode and Light Absorbable Layer

Figure 6:
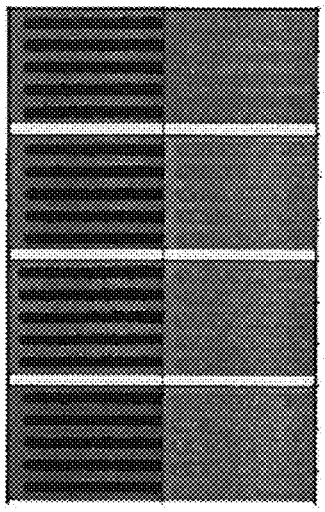
FIG. 6 shows an image showing oxidation results of a first conductive layer including Cu and oxidation results of a second conductive layer including Al and a surface treatment agent.

A glass substrate (10 cm×10 cm) was washed and dried. Then, the first paste was applied to a portion of the glass substrate, and the second paste was applied to another portion of the glass substrate. The glass substrate was then dried in an oven at 100° C. for 15 minutes to form a first conductive layer and a second conductive layer. An exposure mask having a stripe pattern was placed above the first conductive layer and the second conductive layer, and then 450 mJ/cm$^2$ of ultraviolet (UV) rays were irradiated onto the structure from a high-pressure Hg lamp. Then 0.4 wt. % of a sodium carbonate solution at a temperature of 35° C. was ejected through a nozzle for 25 seconds at an ejection pressure of 1.5 kgf/cm$^2$. As a result, each of the first conductive layer and the second conductive layer was patterned in a stripe form. A sintering process was then performed in an electric sintering furnace at 580° C. for 15 minutes. As a result, the first conductive layer was oxidized and a light absorbable layer was formed, and the second conductive layer was not oxidized and a PDP electrode was formed. Referring to FIG. 6, the image on the left shows the oxidation results of the first conductive layer and the image on the right shows the oxidation results of the second conductive layer. As can be seen in FIG. 6, the first conductive layer was turned into a black metal oxide layer, and the second conductive layer was turned into a PDP electrode that is conductive.

A method of manufacturing a PDP substrate structure, according to another embodiment of the present invention, and a PDP substrate structure manufactured using the method will now be described in detail with reference to FIGS. 7-12.

Figure 7:
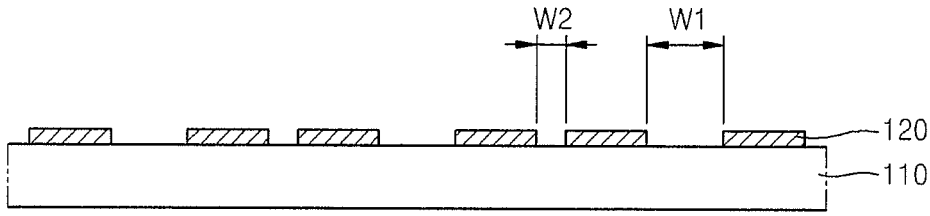
FIGS. 7-12 are sectional schematic views illustrating a method of manufacturing a PDP substrate structure, according to another embodiment of the present invention.

Referring to FIG. 7, a plurality of transparent electrodes 120 are formed on a glass substrate 110. The transparent electrodes 120 are formed in a stripe pattern. The transparent electrodes 120 are separated by first intervals W1, second intervals W2, or both. Adjacent transparent electrodes 120 separated by the first interval W1 causes a display discharge in a discharge cell. A light absorbable layer 140 (FIG. 12) will be formed later on a portion of the glass substrate 110 corresponding to the second interval W2 between adjacent transparent electrodes 120. The transparent electrodes 120 may be formed of a light transmissible conductive material, such as indium tin oxide (ITO).

Figure 8:
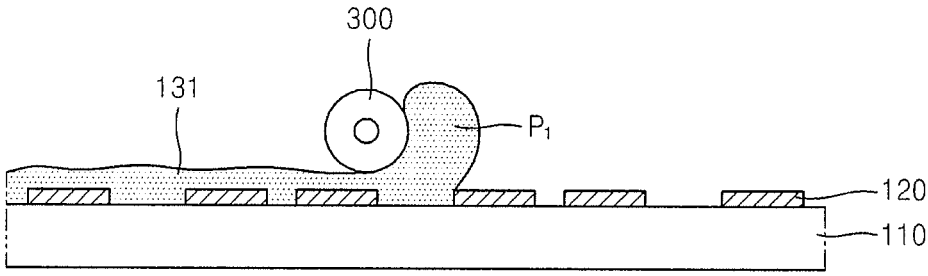

Referring to FIG. 8, a first paste P1 is applied over the transparent electrodes 120 disposed on the glass substrate 110. The first paste P1 includes a black conductive material, such as Cu. The black conductive material may be a solid-state conductive powder and further include glass frits to bind particles of the conductive material, a photosensitive material that is used in a photolithography process, a solvent, and various suitable additives. The photosensitive material includes a photo initiator, a crosslinking agent and a binder.

The first paste P1 is applied with a roller 300, which provides pressure to completely coat and fill the spaces between the transparent electrodes 120.

The applied first paste P1 is dried to form a first conductive layer 131.

Figure 9:
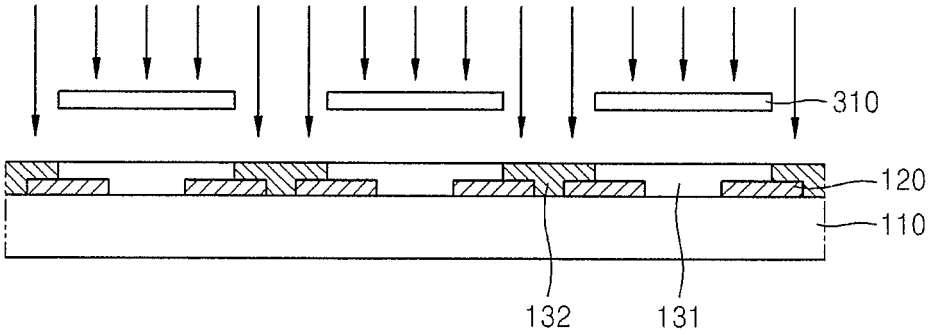

Referring to FIG. 9, an exposure process is performed on the first conductive layer 131 with a first exposure mask 310. The first exposure mask 310 has patterns for allowing certain regions to be formed into bus electrodes and regions to be formed into light absorbable layers, which are exposed to the light source. Since the bus electrodes and the light absorbable layers are formed in the shape of stripe patterns, the patterns of the first exposure mask 310 may correspond to the stripe patterns of the bus electrodes and the light absorbable layers.

The exposed regions 132 of the first conductive layer 131 are hardened because a crosslinking agent, a binder, and a photo initiator cause a polymerization reaction to occur. The exposed regions 132 correspond to the regions that are to be formed into bus electrodes and the regions that are to be formed into light absorbable layers.

Figure 10:
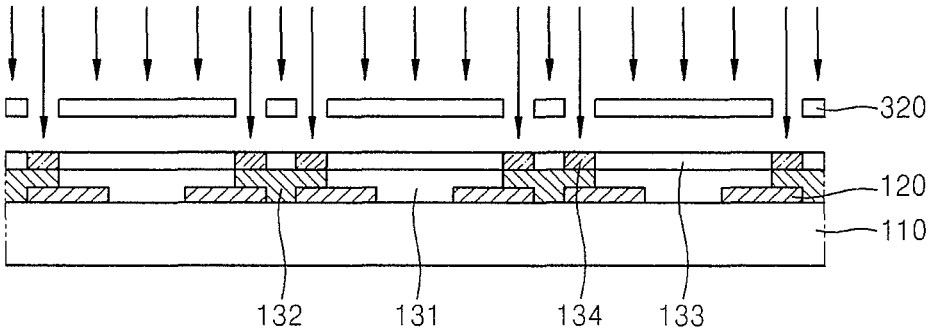

Referring to FIG. 10, after the first conductive layer 131 is exposed, a second paste is applied thereto and dried to form a second conductive layer 133. The second paste includes an Al liquid composition including Al and a surface treatment agent, glass frit, and a vehicle that is utilized in a photolithography process. The vehicle includes a photo initiator, a crosslinking agent, and a binder. The composition of the second paste is the same (or substantially the same) as the second paste as described above.

An exposure process is performed on the second conductive layer 133 with a second exposure mask 320. The second exposure mask 320 has stripe patterns so that regions to be formed into bus electrodes are exposed to a light source.

The exposed regions 134 of the second conductive layer 133 are hardened because of the polymerization reaction of a crosslinking agent, a binder, and a photo initiator.

Figure 11:
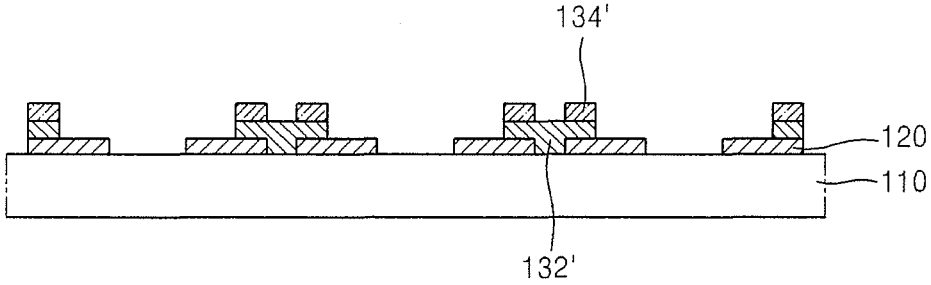

When the exposure process is completed, a development process is performed with an alkaline developing solution to form, as illustrated in FIG. 11, a first conductive layer pattern 132' and a second conductive layer pattern 134'. That is, the exposed regions 132 of the first conductive layer 131 of FIG. 10 and the exposed regions 134 of the second conductive layer 133 of FIG. 10 are respectively formed into the first conductive layer pattern 132' of FIG. 11 and the second conductive layer pattern 134' of FIG. 11.

The first conductive layer pattern 132' is formed on end portions of adjacent transparent electrodes 120 and between the adjacent transparent electrodes 120. The second conductive layer pattern 134' is formed on each of the end portions of the first conductive layer pattern 132'. Specifically, the second conductive layer pattern 134' is formed on a portion of the first conductive layer pattern 132' in which the first conductive layer pattern 132' and end portions of the transparent electrode 120 overlap.

In addition, portions of the first conductive layer pattern 132' are covered by the second conductive layer pattern 134', and portions of the first conductive layer pattern 132' are exposed to the external environment. The exposed portions of the first conductive layer pattern 132' are to be formed into light absorbable layers.

Figure 12:
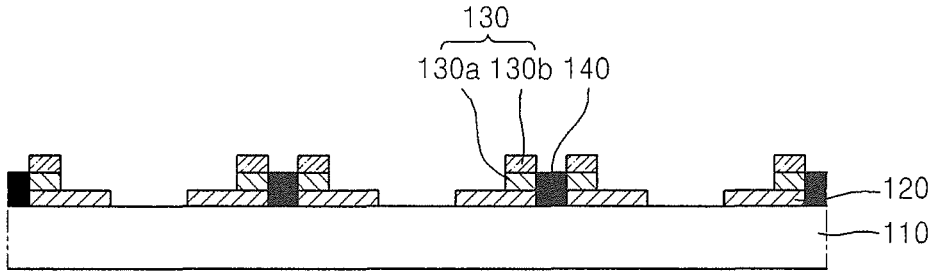

After the first and second conductive layer patterns 132' and 134' are patterned as described above, a sintering process is performed. During the sintering process, the portions of the first conductive layer pattern 132' that are covered by the second conductive layer pattern 134' are not oxidized, and the portions of the first conductive layer pattern 132' that are not covered by the second conductive layer pattern 134' are oxidized, so that the first conductive layer pattern 132' has highly insulating portions. The second conductive layer pattern 134', although being exposed to the outside in the sintering process, is not oxidized because the surface treatment agent remains on the surface of Al particles of the second paste. Since the second conductive layer pattern 134' is not oxidized, it retains its conductivity. The second conductive layer pattern 134' is combined with the portion of the first conductive layer pattern 132' that is not oxidized to form a bus electrode 130. As illustrated in FIG. 12, a portion of the first conductive layer pattern 132' (FIG. 11) forms a lower layer 130*a* of a bus electrode 130, the second conductive layer pattern 134' (FIG. 11) forms an upper layer 130*b* of the bus electrode 130, and another portion of the first conductive layer pattern 132' (FIG. 11) that is exposed and oxidized forms a light absorbable layer 140.

The bus electrode 130 has a low specific resistance of about 20 μΩ·cm or less due to a surface treatment agent existing on a surface of Al particles, which is further enhanced by the conductive material of the first conductive layer 131 (FIG. 8).

The light absorbable layer 140 is formed from a highly insulating oxide and disposed between adjacent bus electrodes 130 and between adjacent transparent electrodes 120, and thus, shorts of the PDP electrode can be prevented (or reduced).

As described, the PDP substrate structure manufactured utilizing the method according to the embodiment of the present invention is part of a top panel of a PDP through which light can be emitted to the outside. The top panel of a PDP can then be manufactured by further forming a dielectric layer and a protective layer on the PDP substrate structure.

Hereinafter, the structure of a PDP including a PDP top substrate structure manufactured as described above will be described in more detail.

Figure 13:
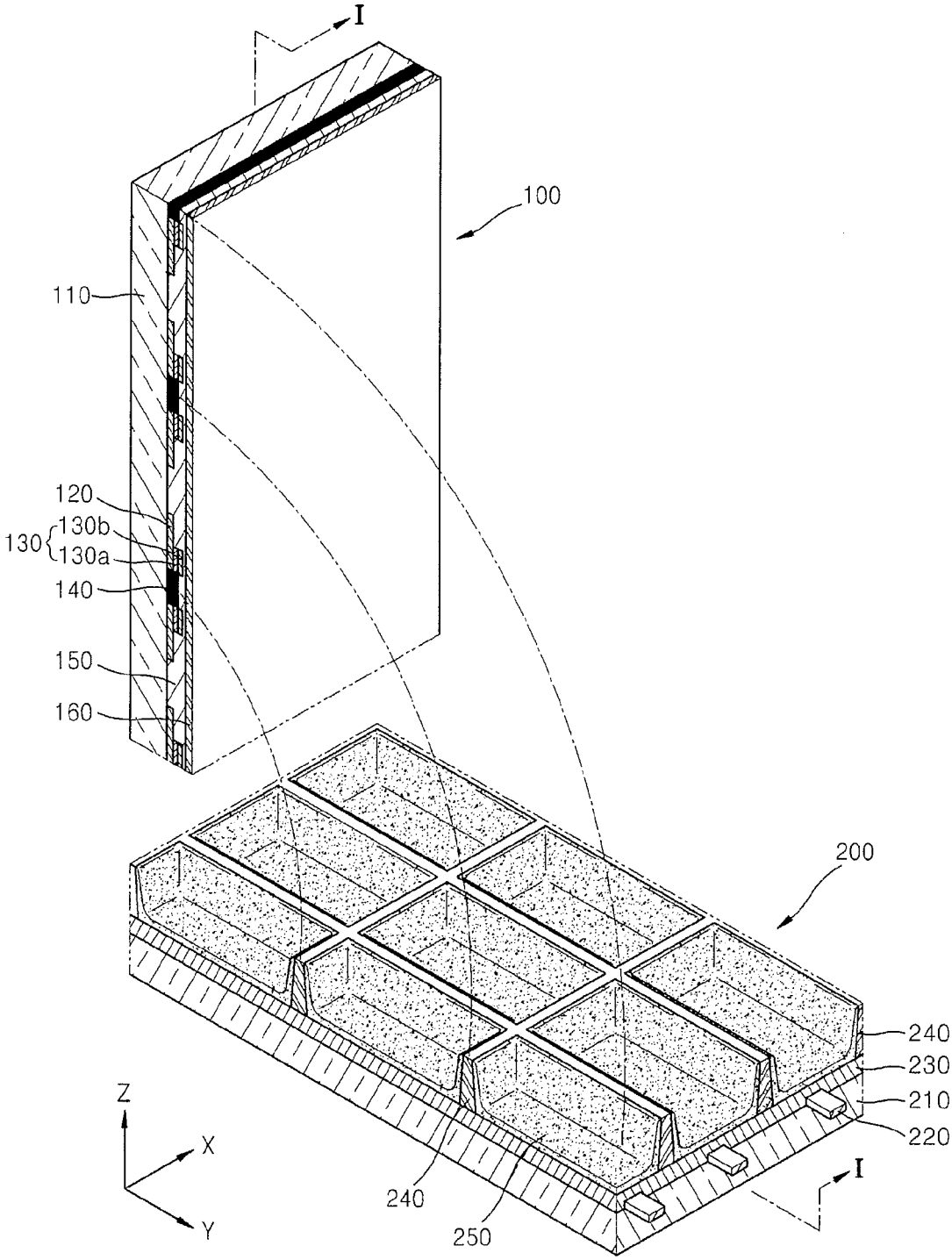
FIG. 13 is an exploded perspective schematic view of a PDP including a PDP substrate structure manufactured utilizing the method illustrated in FIGS. 7-12, according to an embodiment of the present invention.
Figure 14:
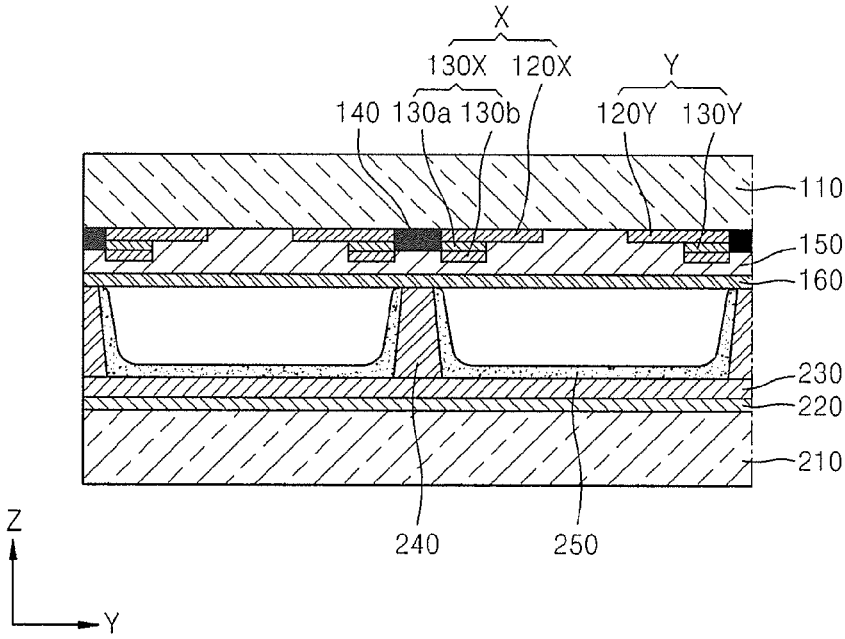
FIG. 14 is a sectional view taken along a line I-I of the PDP illustrated in FIG. 13, according to an embodiment of the present invention.

FIG. 13 is an exploded perspective schematic view of a PDP including a PDP substrate structure manufactured using the method described with reference to FIGS. 7-12. FIG. 14 is a sectional schematic view taken along a line I-I of the PDP illustrated in FIG. 13, according to an embodiment of the present invention.

Referring to FIG. 13, the PDP includes a top panel 100 through which light is emitted to the outside and a bottom panel 200 that includes phosphors for emitting light.

The top panel 100 includes a PDP substrate structure manufactured using the method described with reference to FIGS. 7-12.

Specifically, a plurality of transparent electrodes 120 extend along a top glass substrate 110 in an X direction, and a bus electrode 130 is disposed on each transparent electrode 120, wherein the bus electrode 130 is parallel to the transparent electrode 120. The bus electrode 130 has a double-layered structure, which includes a lower layer 130*a* formed of a conductive material having lower specific resistance than Al and an upper layer 130*b* formed using an Al liquid composition. A light absorbable layer 140 is disposed between adjacent transparent electrodes 120 and between adjacent bus electrodes 130. The light absorbable layer 140 between adjacent bus electrodes 130 corresponds to a top portion of a barrier rib 240. The transparent electrodes 120, the bus electrodes 130 and the light absorbable layer 140 are covered by a top dielectric layer 150 and a protective layer 160 which are sequentially deposited on the top glass substrate 110. The top dielectric layer 150 protects the bus electrodes 130 and the transparent electrodes 120 from direct collision with charge particles involved during discharging. The protective layer 160 protects the top dielectric layer 150. The protective layer 150 can induce emission of secondary electrons to activate the discharging.

In the bottom panel 200, a plurality of address electrodes 220 extend along a bottom glass substrate 210 in a Y direction. The address electrodes 220 are covered by a bottom dielectric layer 230, and the barrier rib 240, which defines a plurality of discharge cells on the bottom dielectric layer 230. A phosphorescent layer 250 is disposed in each discharge cell. Specifically, the phosphorescent layer 250 is disposed on sidewalls of the barrier rib 240 and on the dielectric layer 230. The phosphorescent layers 250 disposed in the discharge cells may be different from each other. For example, the phosphorescent layer 250 may be a red phosphorescent layer, a green phosphorescent layer, or a blue phosphorescent layer.

Referring to FIG. 14, each discharge cell independently emits light because the discharge cell is separated from neighboring discharge cells by the barrier rib 240. Specifically, each discharge cell includes a pair of sustain electrodes X and Y, and an address electrode 220 crossing the pair of sustain electrodes X and Y. The pair of sustain electrodes X and Y includes an X electrode X and a Y electrode Y. The X electrode X includes an X transparent electrode 120X and an X bus electrode 130X, and the Y electrode Y includes a Y transparent electrode 120Y and a Y bus electrode 130Y. Each of the X bus electrode 130X and the Y bus electrode 130Y has a double-layered structure including the lower layer 130*a* formed of a conductive material having lower specific resistance than Al and the upper layer 130*b* formed using an aluminum liquid composition. A voltage is alternatively applied to the pair of sustain electrodes X and Y and causes display discharging, and before the display discharging occurs, an address discharge occurs between the Y electrode Y and the address electrode 220. The address discharge is a preset discharge by which priming particles are accumulated in a discharge cell to be displayed so as to cause a display discharge to emit light toward the outside.

According to embodiments of the present invention described above, although being subjected to a sintering process, the bus electrode 130 including a composite of Al and glass frit in which a surface treatment agent is present on a surface of Al particles can be obtained. In addition, the bus electrode 130 further includes a conductive material, such as Cu, so that the specific resistance of Al can be compensated. Also, in various embodiments, the formation of the bus electrode 130, and oxidation of the conductive material for forming the light absorbable layer 140 can occur at the same time (or substantially the same time). Therefore, since the bus electrode 130 and the light absorbable layer 140 can be simultaneously (or concurrently) formed using inexpensive Al through a photolithography process, the manufacturing process is simple and the yield can be increased.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A plasma display panel (PDP) substrate structure comprising:

a substrate;

an electrode on the substrate and comprising a first layer and a second layer, the second layer comprising an aluminum (Al) material, the first layer being between the substrate and the second layer, the first layer contacting the second layer on one surface and comprising a conductive material, the first layer having a lower specific resistance than that of the second layer, the second layer having a second surface that is directly opposite and not in contact with the first layer or any other electrode layer; and a light absorbable layer on the substrate and adjoining the first layer, the light absorbable layer being an oxidization product of the conductive material of the first layer.

2. The PDP substrate structure of claim 1, wherein the second layer further comprises a surface treatment agent for protecting the Al material from oxidation.

3. The PDP substrate structure of claim 2, wherein the surface treatment agent comprises cellulose ether.

4. The PDP substrate structure of claim 2, wherein the Al material is covered with the surface treatment agent.

5. The PDP substrate structure of claim 2, wherein the Al material comprises sintered Al particles.

6. The PDP substrate of claim 1, wherein the conductive material of the first layer comprises copper (Cu) or nickel (Ni).

7. The PDP substrate of claim 1, wherein the light absorbable layer is substantially black in color.

8. The PDP substrate of claim 1, wherein the light absorbable layer is an insulator for protecting the electrode from an electrical short circuit.

9. The PDP substrate of claim 1, wherein the electrode has a specific resistance of about 20 μΩ·cm or less.

10. A plasma display panel (PDP) substrate structure comprising:

a substrate;

an electrode on the substrate, the electrode consisting of a first layer and a second layer, the second layer comprising an aluminum (Al) material, the first layer being between the substrate and the second layer, the first layer contacting the second layer on one surface and comprising a conductive material, the second layer having a second surface that is directly opposite and not in contact with the first layer or any other electrode layer, the electrode having a specific resistance not greater than 20 μΩ·cm; and a light absorbable layer on the substrate and adjoining the first layer, the light absorbable layer being an oxidization product of the conductive material of the first layer.

11. A plasma display panel comprising:

a first substrate;

a second substrate facing the first substrate;

a first electrode on the first substrate, extending along a first direction, and comprising a first layer and a second layer, the second layer comprising an aluminum (Al) material, the first layer being between the first substrate and the second layer, the first layer contacting the second layer on one surface and comprising a conductive material having a lower specific resistance than that of Al, the second layer having a second surface that is directly opposite and not in contact with the first layer or any other electrode layer;

a light absorbable layer on the first substrate and adjoining the first layer, the light absorbable layer being an oxidization product of the conductive material of the first layer;

a dielectric layer on the first substrate to cover the first electrode and the light absorbable layer; and a second electrode spaced apart from the first electrode and on the second substrate, and extending along a second direction crossing the first direction.

12. The plasma display panel of claim 11, further comprising a third electrode between the first substrate and the first electrode and extending in the first direction.

13. The plasma display panel of claim 12, wherein: the third electrode is a transparent electrode; the first electrode is a bus electrode on the transparent electrode; and the second electrode is an address electrode.

14. The plasma display panel of claim 11, further comprising a barrier rib between the first electrode and the second electrode, wherein the light absorbable layer corresponds in position to a portion of the barrier rib extending in the first direction to overlap with the portion of the barrier rib extending in the first direction.

15. The plasma display panel of claim 11, wherein the second layer further comprises a surface treatment agent for protecting the Al material from oxidation.

16. The plasma display panel of claim 15, wherein the Al material of the second layer comprises sintered Al particles.

17. The plasma display panel of claim 11, wherein the conductive material of the first layer comprises copper (Cu) or nickel (Ni).

18. The plasma display panel of claim 11, wherein the light absorbable layer is an insulator for protecting the first electrode from an electrical short circuit.

19. The plasma display panel of claim 11, wherein the first electrode has a specific resistance of about 20 μΩ·cm or less.

20. A plasma display panel (PDP) substrate structure comprising:

a substrate;

an electrode on the substrate and comprising a first layer and a second layer, the second layer comprising a first conductive material and a surface treatment agent for protecting the first conductive material from oxidation, the first layer being between the substrate and the second layer, the first layer contacting the second layer on one surface and comprising a second conductive material having a lower specific resistance than that of the first conductive material, the second layer having a second surface that is directly opposite and not in contact with the first layer or any other electrode layer; and a light absorbable layer on the substrate and adjoining the first layer, the light absorbable layer being an oxidization product of the second conductive material of the first layer.

21. The PDP substrate structure of claim 20, wherein the surface treatment agent comprises cellulose ether.

22. The PDP substrate structure of claim 20, wherein the first conductive material is covered by the surface treatment agent.

23. The PDP substrate structure of claim 20, wherein the first conductive material comprises aluminum and the second conductive material comprises copper (Cu) or nickel (Ni).

* * * * *